US011299315B2

(12) United States Patent
Yen

(10) Patent No.: US 11,299,315 B2
(45) Date of Patent: Apr. 12, 2022

(54) FOLDABLE BOX CONNECTION STRUCTURE, FOLDABLE BOX AND METHOD OF USING THE SAME

(71) Applicant: INTERNATIONAL DESIGN PACKING CO., LTD., Suzhou (CN)

(72) Inventor: Wentai Yen, Suzhou (CN)

(73) Assignee: INTERNATIONAL DESIGN PACKIG CO., LTD., Suzhou (CN)

( * ) Notice: Subject to any disclaimer, the term of this patent is extended or adjusted under 35 U.S.C. 154(b) by 0 days.

(21) Appl. No.: 16/975,133

(22) PCT Filed: Jul. 26, 2019

(86) PCT No.: PCT/CN2019/097846
§ 371 (c)(1),
(2) Date: Feb. 4, 2021

(87) PCT Pub. No.: WO2021/016732
PCT Pub. Date: Feb. 4, 2021

(65) Prior Publication Data

US 2021/0309409 A1 Oct. 7, 2021

(51) Int. Cl.
*B65D 5/18* (2006.01)
*B65D 5/46* (2006.01)
*B65D 5/66* (2006.01)

(52) U.S. Cl.
CPC ..... *B65D 5/18* (2013.01); *B65D 5/46* (2013.01); *B65D 5/6685* (2013.01); *B65D 2313/04* (2013.01)

(58) Field of Classification Search
CPC ..... B65D 5/4616; B65D 5/36; B65D 5/3685; B65D 5/322–325; B65D 5/18; B65D 5/32
(Continued)

(56) References Cited

U.S. PATENT DOCUMENTS 2,014,695 A * 9/1935 Peterson ..... B65D 5/248 229/172
2,913,967 A * 11/1959 Scriven, Jr. ..... B65D 5/248 493/82

(Continued)

FOREIGN PATENT DOCUMENTS

CN 201049756 4/2008
CN 201049756 Y 4/2008

(Continued)

OTHER PUBLICATIONS

Supplementary European Search Report, EP 19 91 2202.

*Primary Examiner* — Nathan J Newhouse
*Assistant Examiner* — Phillip D Schmidt
(74) *Attorney, Agent, or Firm* — Treasure IP Group, LLC

(57) ABSTRACT

The invention provides a foldable box connection structure, a foldable box and a method of using the same. The foldable box connection structure comprises a first side plate, a second side plate, a first hinge, a first top plate, a seam cover plate and a positioning plate. The first hinge is used to connect the first top plate and the second side plate. The seam cover plate can be folded to cover the first hinge, and the seam cover plate and the positioning plate are configured to secure the first hinge. The foldable box includes the above-mentioned connection structure. In the present invention, the first top plate is hooked by the first hinge and the seam cover plate, and a second top plate is hooked by a third hinge, so that the foldable box has a fixed structure.

9 Claims, 8 Drawing Sheets

(58) Field of Classification Search
USPC ..... 229/117.14, 122.23, 122.26, 192, 113, 229/122.32, 199; 206/141; 493/84; 53/461
See application file for complete search history.

(56) References Cited

U.S. PATENT DOCUMENTS

| | | | | |
|---|---|---|---|---|
| 8,910,855 | B2 * | 12/2014 | Wong | B65D 5/3635 229/122.34 |
| 2010/0314436 | A1 * | 12/2010 | Tao | B65D 5/324 229/122.24 |

FOREIGN PATENT DOCUMENTS

| | | | | |
|---|---|---|---|---|
| CN | 103569439 | A * | 2/2014 | |
| CN | 103569439 | A | 2/2014 | |
| CN | 205891500 | | 1/2017 | |
| DE | 102018009118 | A1 * | 5/2020 | B31B 50/16 |
| GB | 463482 | | 3/1937 | |
| JP | 10335876 | U | 2/1978 | |
| KR | 1020060130638 | | 1/2007 | |
| SE | 1700047 | A1 | 9/2017 | |
| WO | 2004089763 | | 10/2004 | |
| WO | 2008064553 | A1 | 6/2008 | |

* cited by examiner

FOLDABLE BOX CONNECTION STRUCTURE, FOLDABLE BOX AND METHOD OF USING THE SAME

FIELD OF THE INVENTION

The invention relates to the field of boxes, in particular to a foldable box connection structure, a foldable box and a method of use thereof.

BACKGROUND OF THE INVENTION

With the rapid development of modern society and continuous improvement of people's living standards, people's demand for foldable boxes will continue to increase, and higher requirements will be placed on the quality of folding boxes. At present, common foldable boxes available at the market are usually made of paper, such as gift boxes and packaging boxes, which need to be carried in a handbag when transporting, and it is very inconvenient to be used.

Further, the foldable boxes currently available at the market are generally made of corrugated material. When the folded box is lifted to form a box, triangular shaped gap occurs between the lid and the wall of the folded box due to gravity, which negative affects the simple and beautiful appearance of the box. Additionally, under repeated lifting and pull of the box, the box will become susceptible for damage, which greatly reduces the service lifetime of the box.

SUMMARY OF THE INVENTION

The purpose of the present invention is to provide a foldable box and a method of using the same, which solves the problem of a triangular gap between the cover and the box wall of the existing portable box due to gravity.

In order to achieve the above objective, the present invention proposes the following technical solutions. The foldable box comprises a first side plate, a second side plate, a first hinge, a first top plate, a seam covering and pressing plate, and a positioning plate. The seam covering and pressing plate and the positioning plate are sequentially folded and connected along a length direction of the first side plate, defining the edge of the connection between the first side plate and the first top plate as the first connecting edge, one side of the second side plate is connected with adjacent sides of the first connecting side when folded.

The first hinge is a double crease folding structure, and it is defined that the two creases in the double crease are the first crease and the second crease respectively, and the middle area of the two creases is the first movable area, the part outside the first movable area is defined as an outer area, wherein the outer area of the first crease is adhered and fixed to the second side plate, and the area outside the second crease is adhered and fixed to the first top plate.

When the second side plate and the first side plate are folded into a planar structure, the first top plate and the first side plate are expanded at a maximum angle, and the first movable area covers the area outside the second crease, and the first movable area is attached to the first top plate.

When the second side plate and the first side plate are expanded at the maximum angle to form a spatial structure, the first top plate and the first side plate are expanded at the minimum angle, the first movable area is attached to the first top plate, and the second side plate, the first side plate, and the first top plate form a closed three-sided angle.

When the second side plate and the first side plate are expanded at the maximum angle, the seam covering and pressing plate is folded to cover the first top plate, defining a folding line where the first connecting edge is located as a third crease. A fourth crease is formed with the positioning plate and seam covering and pressing plate. The third crease is attached to the fourth crease, and the first movable area of the first hinge is sandwiched between the first top plate and the seam covering and pressing plate.

In order to further enable the seam covering and plate and the positioning plate to fix the first hinge, preferably, the surface of the first side plate is fixedly connected to the position-limiting plate, when the second side plate and the first side plate are expanded to form a maximum angle and when the seam covering and pressing plate are folded to cover the first top plate, the positioning plate is attached to the first side plate, and the positioning plate is clamped between the position-limiting plate and the first top plate. By designing width of the positioning plate and the distance between the position-limiting plate and the first top plate, a lock state is achieved. In order to ensure the effect of the engagement, the thickness of the positioning plate should not be too thin and if too soft, it will cause failure. Generally, the thickness of the position-limiting plate is designed to be higher than the positioning plate. The position-limiting plate can positioning-limitthe position of the positioning plate. When the first side plate and the first top plate are configured to be in the three-dimensional structure, the seam covering and pressing plate and the positioning plate are turned inward to make the seam covering and pressing plate can be used to cover on the first hinge, and the positioning plate is clamped between the position-limiting plate and the first top plate. The position-limiting plate can fix the position of the seam covering and pressing plate and the positioning plate, so that the first side plate and the first top plate is continuously in the three-dimensional structure, avoiding a gap between the first top plate and the second side plate.

A foldable box includes the above-mentioned connection structure.

More specifically, to define a box: the first state of the box is a folded and flat state, and the second state of the box is an unfolded or expanded three-dimensional forming state and forms an accommodation space;

The box comprises: a first lifting plate, a first top plate, a first side plate, a bottom plate, a third side plate, a second top plate, and a second lifting plate, which are sequentially folded to form a box.

It further comprises two second side plates, and the two second side plates are respectively folded and connected to the two adjacent sides of the first connecting side of the first side plate, defining the connection between the second side plate and the first side plate side is a second connecting side, each of the second side plates includes a bottom plate, a first hinge and a second hinge, and the first hinge and the second hinge are each disposed on the adjacent sides respectively, on both sides of the second connecting side.

The second hinge is a double crease folding structure, and the two creases in the double crease are defined as a fifth crease and a sixth crease respectively, and the middle area of the two creases is called the second movable area, the part outside the second movable area is defined as an outer area, wherein the outer area of the fifth crease and the second side plate are adhered and fixedly connected, and the outer area outside the sixth crease is adhered and fixedly connected to the bottom plate.

When the second side plate and the bottom plate are folded into a planar structure, the bottom plate and the first side plate are expanded at a maximum angle, the second movable area covers the area outside the fifth crease, and the second movable area is adhered and fixedly attached to the bottom plate;

When the second side plate and the bottom plate are expanded at the maximum angle, the bottom plate and the first side plate are expanded at the minimum angle, and the second movable area is adhered and fixedly attached to the bottom plate.

The first hinge is a double crease folding structure, and it is defined that the two creases in the double crease are the first crease and the second crease respectively, and the middle area of the two creases is the first movable area. The area outside the first movable area is defined as the outer area, wherein the outer area of the first crease is adhered and fixed to the second side plate, and the area outside the second crease is adhered and fixed to the first top plate. When the second side plate and the first side plate are folded into a planar structure, the first top plate and the first side plate are expanded at the maximum angle, and the first movable area covers the area outside the second crease, and the first movable area is attached to the first top plate.

When the second side plate and the first side plate are expanded at the maximum angle, the first top plate and the first side plate are expanded at the minimum angle, and the first movable area is attached to the first top plate.

Both sides of the inner wall of the second top plate are provided with third hinges. The second top plate is foldably connected to the third side plate through the third hinges on both sides. The hinge is foldably connected to the third side plate, and the third hinge can make the second top plate and the third side plate fold or unfold to form a movable connection, and in the unfolded and expanded state, when the second top plate receives an upward pulling force, the third hinge can be used to fix the second top plate in place and eliminate gaps between the second top plate and the second side plate.

The foldable box further comprises a seam covering and pressing plate, a positioning plate and a position-limiting plate. The seam covering and pressing plate is folded and connected at the connection between the first top plate and the first lifting plate, and defining when the seam covering and pressing plate is folded inward and covers the surface of the first hinge as a locked state. When the seam covering and pressing plate is in the locked state, the positioning plate is parallel to the first side plate and is attached to the inner surface of the first side plate, and the position-limiting plate locks the position of the positioning plate In the same way, here, the positioning-limit plate can limit the position of the positioning plate. When the box is in the second state, the first side plate and the first top plate need to be turned inward when they are in the three-dimensional structure. The seam covering and pressing plate and the positioning plate enable the seam covering and pressing plate to be covered on the first hinge, and the positioning plate is clamped between the position-limiting plate and the first top plate. The position-limiting plate can secure the positions of the seam covering and pressing plate and the positioning plate, so that the first side plate and the first top plate are continuously positioned in the three-dimensional structure, while avoiding gaps between the first top plate and the second side plate.

In order to protect the inner wall of the second side plate and the first side plate, preferably, a patch is provided between the second side plate and the first side plate, and a part of the patch is pasted on the inner wall of the second side plate, so the other part of the patch is pasted on the first side plate, and the patch forms an indentation, and the indentation is attached to the connection between the second side plate and the first side plate. The objects are separated from the second side plate, thereby protecting the second side plate and extending the service life of the second side plate.

In order to extend the service life of the first lifting plate, the first top plate, the first side plate, the bottom plate, the third side plate, the second top plate and the second lifting plate, preferably, the first lifting plate, the first top plate, the first side plate, the bottom plate, the third side plate, the second top plate and the second lifting plate are all pasted with lining paper, and the lining paper makes the first lifting plate, the first top plate, the first side plate, the bottom plate, the third side plate, the second top plate and the second lifting plate are more beautiful. At the same time, the lining paper improves the connectivity of the first lifting plate, the first top plate, the first side plate, the bottom plate, the third side plate, the second top plate and the second lifting plate. Further, the inner liner has good foldability, which is beneficial to the first lifting plate, the first top plate, the first side plate, the bottom plate, and the third side plate, the second top plate and the second lifting plate are repeatedly folded for a long time, which extends the service life of the box.

In order to make the first lifting plate and the second lifting plate fit more closely, preferably, the inner side of the first lifting plate and the second lifting plate are provided with magnets attracting each other, and the inner liner paper covers the surface of the magnet, the magnet can attract the first lifting plate and the second lifting plate together in the second state, which makes the attachment effect better, increases the stability and minimizes the gap between first top plate and the second top plate.

In order to facilitate the user to use the box, preferably, the first lifting plate, the first top plate, the first side plate and the second lifting plate, the second top plate, and the third side plate are respectively arranged symmetrically with respect to the bottom plate. The two second side plates are symmetrically arranged with respect to the bottom plate, and both the first lifting plate and the second lifting plate are provided with mutually symmetrical through holes, which can be convenient for the user to lift, and the user can extend his hand to the inside of the through hole to lift up the box, and when the box is placed, the box can also be hung through the through hole, which brings convenience to the user.

In order to reduce the gap between the second top plate and the second side plate, preferably, the third hinge includes a first flap and a second flap, and one side of the second flap is attached to the second top plate. One side of a flap is attached to the third side plate, and when the third hinge is folded inward, a seventh crease is formed between the first flap and the second flap;

A third hinge is pasted on both sides of the inner wall of the second top plate, and the second top plate is foldably connected to the third side plate by means of two third hinges on both sides;

When the second top plate and the third side plate are folded into a planar structure: the second flap and the first flap are folded through the seventh crease, and the second flap is attached to the first flap;

When the second top plate and the third side plate are unfolded into a spatial structure: the second flap and the second top plate are unfolded relative to the seventh crease.

In order to make the foldable box have better foldability and expandability, preferably, when the box is in the first state, the first lifting plate, the first top plate, the first side plate, the bottom plate, the third side plate, and the second top plates and the second lifting plate are at the same horizontal plane;

The seam covering and pressing plate and the positioning plate are folded outward to the inner wall of the first lifting plate;

The second side plate is folded inwardly on the inner wall of the first side plate;

Both the first hinge and the second hinge are folded inward.

In order to make the foldable box have better foldability and expandability, preferably, when the box is in the second state, the two second side plates are symmetrically folded and stand on the top of the bottom plate;

The first side plate and the third side plate are symmetrically folded and stand on the top of the bottom plate, and the inner walls of the first side plate and the third side plate are respectively in close contact with the two sides of the second side plate;

The first top plate and the second top plate cover the top of the second side plate, and adjacent sides of the first top plate and the second top plate are in contact;

The first lifting plate and the second lifting plate stand on the top of the first top plate and the second top plate respectively and are connected by magnet attraction;

The seam covering and pressing plate is in a locked state;

The third hinge is expanded into a plane.

A method of using a foldable box is described below. The folded box is unfolded as follows. Step 1: Unfold the folded first hinge and second hinge, so that the first hinge completely fits the first top plate and the second hinge completely fit the bottom plate, that is, the two second side plates are folded outward and vertically erected. At this time, the two second side plates respectively pull up the bottom plate and the first top plate through the second hinge and the first hinge;

Step 2: Fold the seam covering and pressing plate and positioning plate inward again, so that the seam covering and pressure plate covers the surface of the first hinge, and the limit plate clamps the positioning plate;

Step 3: Finally, fold the third side plate, the second top plate and the second lifting plate inward so that the magnets on the second lifting plate and the first lifting plate attract each other.

Beneficial effects: the technical solution of this application has the following technical effects:

1. In the present invention, the first top plate is hooked by the first hinge and the seam covering and pressing plate, and the second top plate is hooked by the third hinge, so as to achieve the purpose of making the folding box have a fixed structure, that is, in the unfolded state, to make the first top plate and second top plate fits tightly with the second top plate on the top to avoid gaps between the first top plate and the second top plate and the second side plate, which greatly increases the compactness of the box and makes the box simple and beautiful.

2. The present invention enables the box to be compressed into a flat state, reduces the space required for placement, is convenient for storage and transportation, and is very convenient for use and storage.

3. The present invention can achieve the effect of being hand-held. The foldable box is stable after being assembled, and can be laid flat again after being assembled, repeatedly folded and unfolded for use, achieving the purpose of multiple reuse.

4. When the foldable box described in present invention expands to the three-dimensional state and forms the accommodating space, the bottom plate, the first side plate and the second side plate, and the bottom plate, the first side plate and the third side plate form a three-sided angle, which in turn makes the hole at the junction of the box extremely small, increase the space tightness and structural stability.

It should be understood that all combinations of the aforementioned concepts and the additional concepts described in more detail below can be regarded as part of the inventive subject matter of the present disclosure as long as such concepts are not mutually contradictory.

The foregoing and other aspects, embodiments and features of the teachings of the present invention can be more fully understood from the following description with reference to the accompanying drawings. Other additional aspects of the present invention, such as the features and/or beneficial effects of the exemplary embodiments, will be apparent in the following description, or learned from the practice of specific embodiments taught by the present invention.

BRIEF DESCRIPTION OF THE DRAWINGS

The drawings are not intended to be drawn to scale. In the drawings, each identical or nearly identical component shown in each figure may be represented by the same reference numeral. For clarity, not every component is labeled in every figure. Now, embodiments of various aspects of the present invention will be described by way of examples and with reference to the accompanying drawings, in which.

In the figure, the meanings of the reference signs are as follows: 1. a bottom plate; 2. A first side plate; 3. second side plates; 31. a bottom edge; 4. a patch; 5. a first hinge; 51. a first crease 6. a second hinge; 61. a second crease; 7. a first top plate; 8. a seam covering and pressing plate; 9. a positioning plate; 91. a short side; 10. a first lifting plate; 11. a position limiting plate 12, a third side plate; 13, a second top plate; 14, a third hinge; 141, a first flap; 142, a second flap; 15, a second lifting plate; 16, an inner lining paper.

DESCRIPTION OF THE EMBODIMENTS

In order to better understand the technical content of the present invention, specific embodiments are described below in conjunction with the accompanying drawings.

In this disclosure, various aspects of the present invention are described with reference to the accompanying drawings, in which numerous illustrated embodiments are shown. The embodiments of the present disclosure are not necessarily intended to include all aspects of the present invention. It should be understood that the various concepts and embodiments introduced above, as well as those described in more detail below, can be implemented in any of many ways, because the concepts and embodiments disclosed in the present invention are not Limited to any implementation. In addition, some aspects disclosed in the present invention can be used alone or in any appropriate combination with other aspects disclosed in the present invention.

Figure 1:
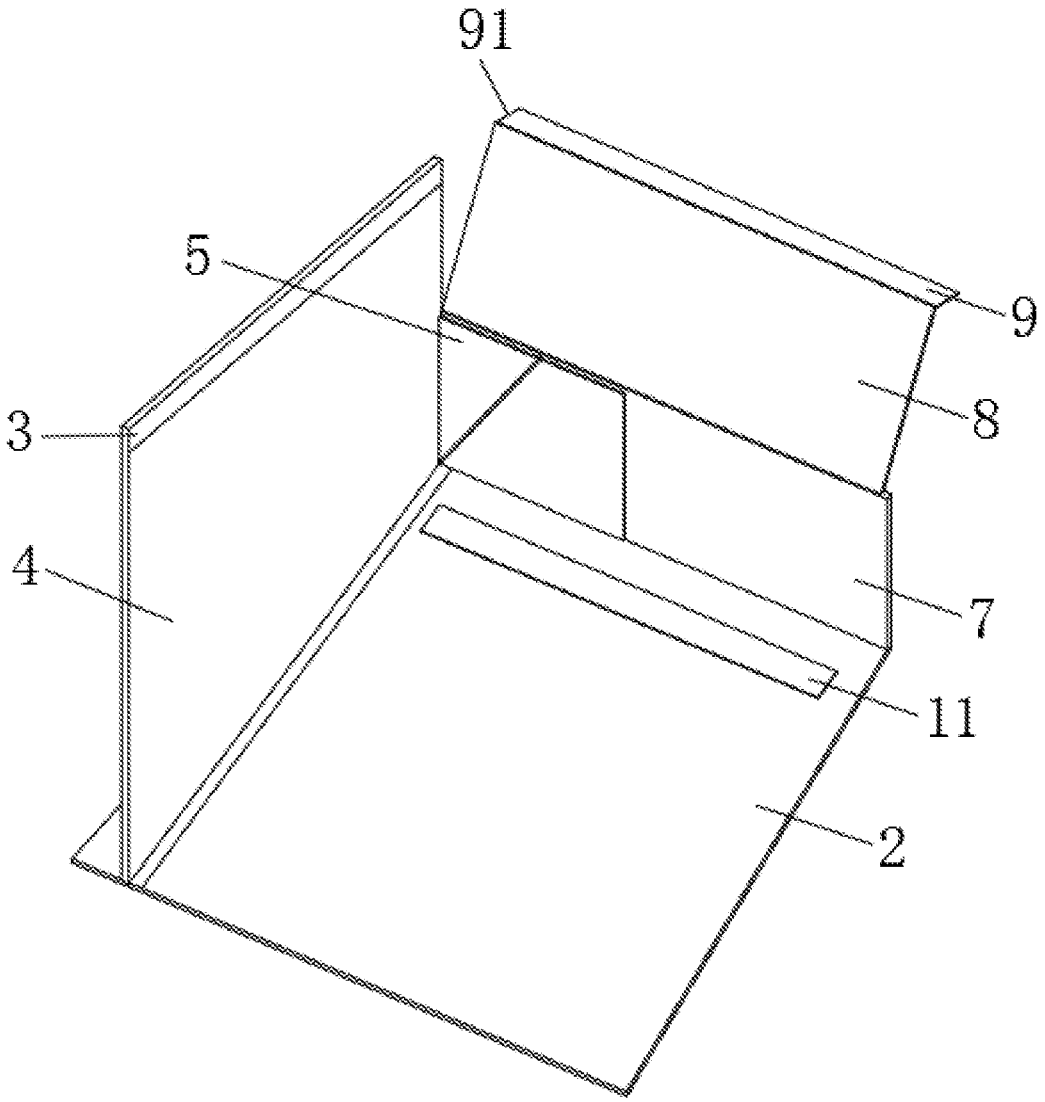
FIG. 1 is a schematic diagram of the unfolded fixing structure of the present invention.
Figure 2:
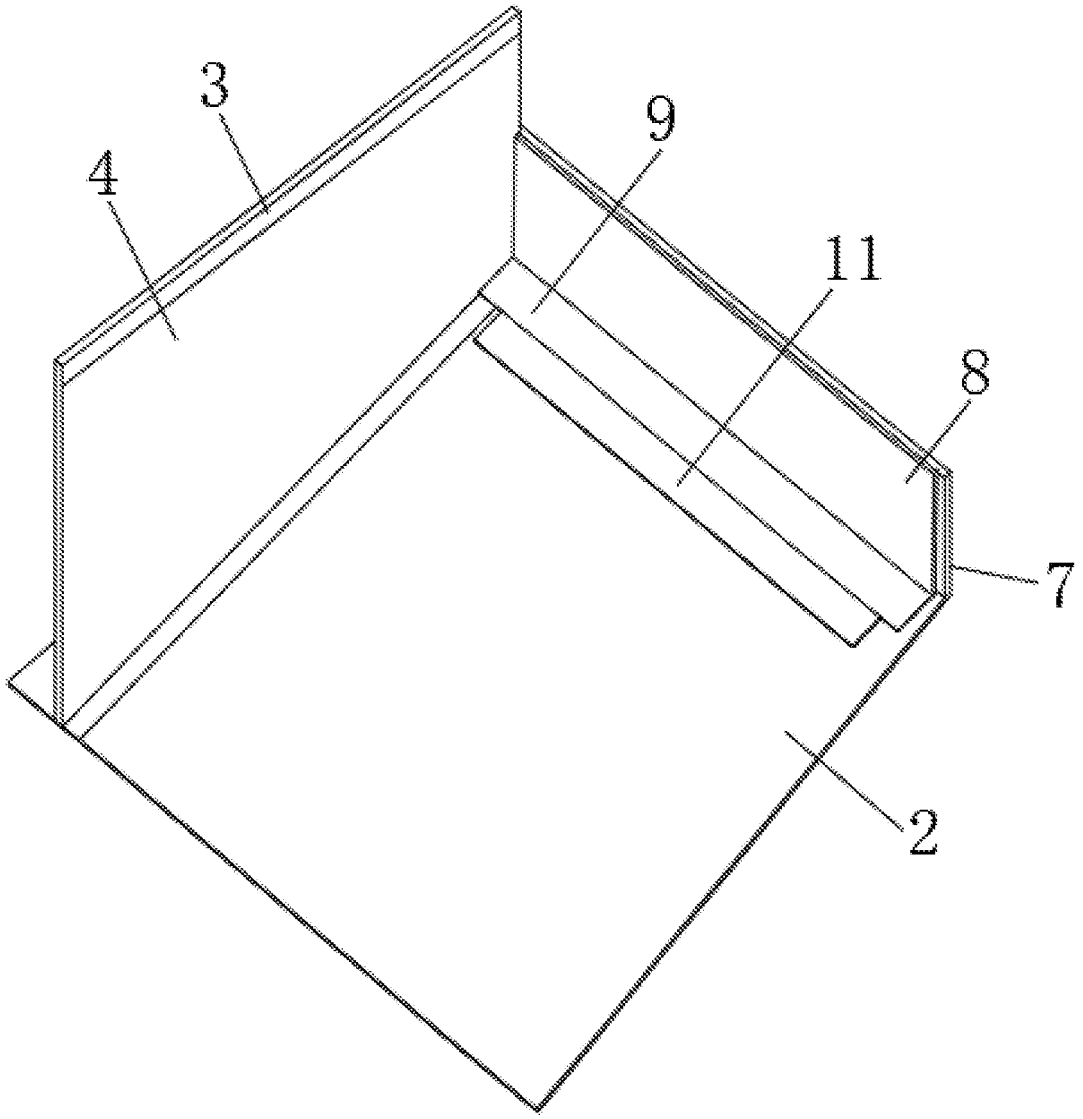
FIG. 2 is a schematic diagram of the locking of the fixing structure of the present invention.
Figure 3:
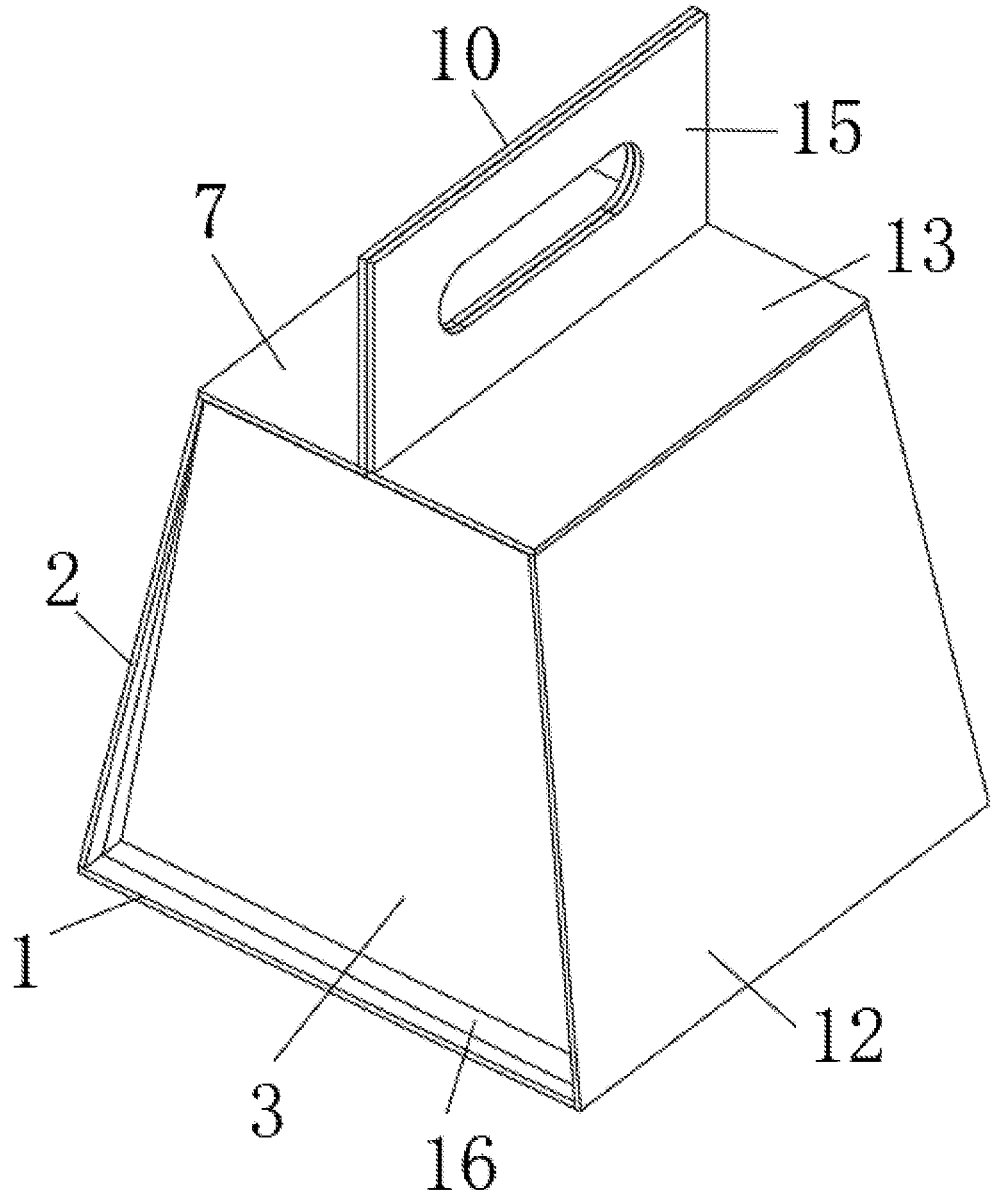
FIG. 3 is a schematic diagram of the three-dimensional structure of the present invention.

As shown in FIGS. 1 to 2, a foldable box connection structure includes a first side plate 2, a second side plate 3, a first hinge 5, a first top plate 7, a seam covering and pressing plate 8 and a positioning plate 9. The first side plate 2, the first top plate 7, the seam covering and pressing plate 8 and the positioning plate 9 are sequentially folded and connected along the length direction of the first side plate 2. Defining the edge of the connection between the first side plate 2 and the first top plate 7 as the first connecting side, and one side of the second side plate 3 is folded and connected to the adjacent side of the first connecting side.

The first hinge 5 is a double crease folding structure. The two creases in the above double crease are defined as the first crease and the second crease respectively, and the middle area of the two creases is the first movable area. The part outside the first movable area is defined as the outer area, where the outer area of the first crease is attached and fixed to the second side plate 3, and the area outside the second crease is attached and fixed to the first top plate 7.

When the second side plate 3 and the first side plate 2 are folded into a planar structure, the first top plate 7 and the first side plate 2 are expanded at the maximum angle, and the first movable area covers the area outside the second crease, and the first movable area attached to the first top plate 7.

When the second side plate 3 and the first side plate 2 are expanded at the maximum angle to form a spatial structure state, the first top plate 7 and the first side plate 2 are expanded at the minimum angle, the first movable area is attached to the first top plate 7, and the second side plate 3. The first side plate 2 and the first top plate 7 form a closed three-sided angle.

When the second side plate 3 and the first side plate 2 are unfolded at the maximum angle, the seam covering and pressing plate 8 is folded and covers the first top plate 7, and the crease where the first connecting edge is defined as the third crease. The positioning plate 9 forms a fourth crease, and the third crease is attached to the fourth crease. The first movable area of the first hinge 5 is sandwiched between the first top plate 7 and the seam covering and pressing plate 8.

In order to further enable the seam covering and pressing plate and the positioning plate to fix the first hinge, the surface of the first side plate 2 is fixedly connected to the positioning-limit plate 11, and when the second side plate 3 and the first side plate 2 are expanded at the maximum angle, and the seam covering and pressing plate 8 is folded and covers on the first top plate 7, the positioning plate 9 is attached to the first side plate 2, and the positioning plate 9 is clamped between the position-limiting plate 11 and the first top plate 7. The positioning plate 9 is engaged securely by designing a width of the position plate 9 and designing a distance between the positioning-limit plate 11 and the first top plate 7;

In order to ensure the effect of the engagement, the thickness of the positioning plate 9 should not be too thin. If the position plate 9 is too soft, it will cause failure. Generally, the thickness of the positioning-limit plate 11 is designed to be greater than the thickness of the positioning plate 9. The positioning-limit plate 11 can adjust the position of the positioning plate 9, when the first side plate 2 and the first top plate 7 are required to be in a three-dimensional structure, the seam covering and pressing plate 8 and the positioning plate 9 are turned inward so that the seam covering and pressing plate 8 can be cover the first hinge 5 and positioning plate 11 is clamped between the position-limiting plate 9 and the first top plate 7. The positioning plate 11 can fix the position of the seam covering and pressing plate 8 and the positioning plate 9 so that the first side plate 2 and the first top plate 7 are continuously in position to form three-dimensional structure and avoid the gaps between the first top plate 7 and the second side plate 3.

Based on the above connection structure, the present invention provides a foldable box including the connection structure.

As shown in FIG. 3-9, specifically, the box is defined: the first state of the box is a folded and flat state, and the second state of the box is an unfolded three-dimensional spatial state and forms an accommodation space.

Figure 8:
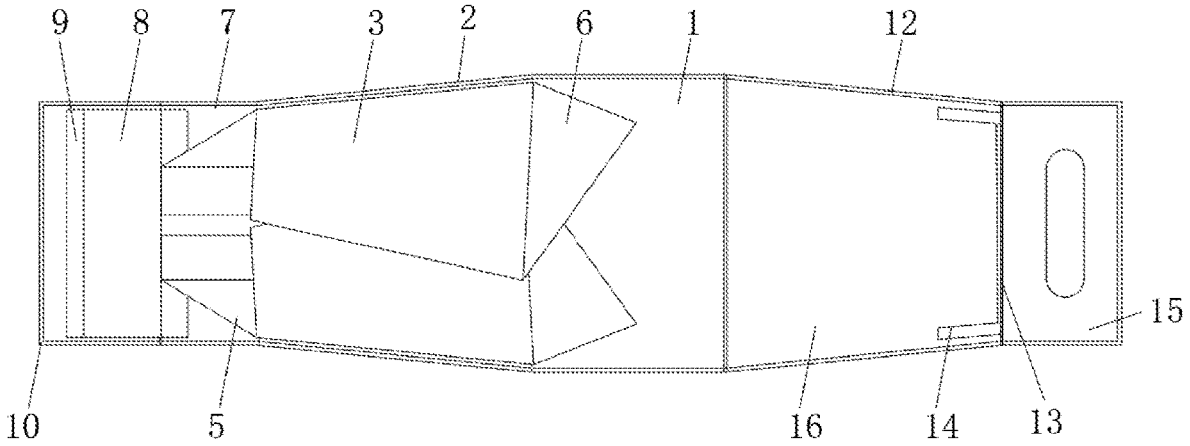
FIG. 8 is a schematic front view of the first state of the present invention.
Figure 9:
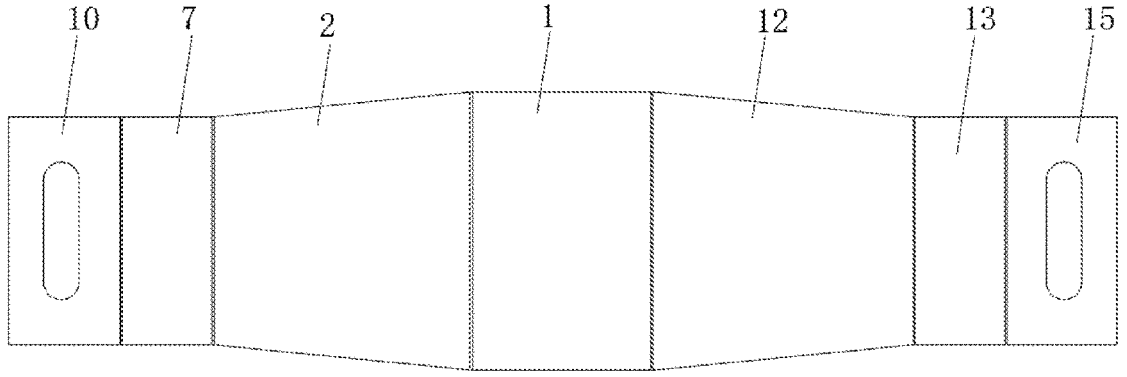
FIG. 9 is a schematic view of the back of the first state of the present invention.

As shown in FIGS. 8-9, the box includes: a first lifting plate 10, a first top plate 7, a first side plate 2, a bottom plate 1, a third side plate 12, a second top plate 13, and a second lifting plate 15, which are configured to be folded in sequence.

It also comprises two second side plates 3, and the two second side plates 3 are respectively folded and connected to two adjacent sides of the first connecting side on the first side plate 2 in a one-to-one correspondence;

Define the edge of the second side plate 3 connected with the first side plate 2 as the second connecting edge. Each second side plate 3 includes a bottom edge 31, a first hinge 5 and a second hinge 6, the first hinge 5 and the second hinge 6 are respectively arranged on the adjacent sides on both sides of the second connecting side. The second hinge 6 can make the second side plate 3 and the bottom plate 1, fold or unfold to form a movable connection. The two second side plates 3 are in the second state, it can cooperate with the first side plate 2 and the third side plate 12 to form an accommodating cavity, which is convenient for users to place articles inside.

Figure 6:
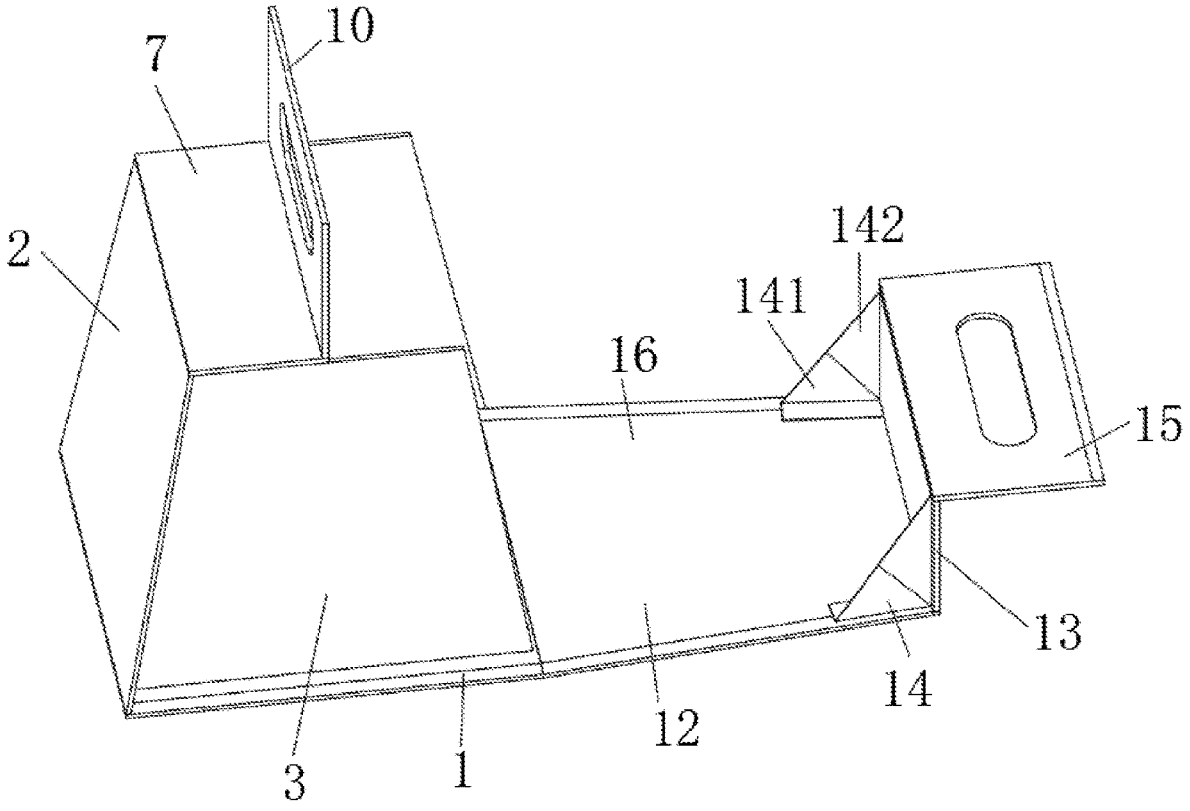
FIG. 6 is a perspective schematic view of the present invention in a partially unfolded state.
Figure 7:
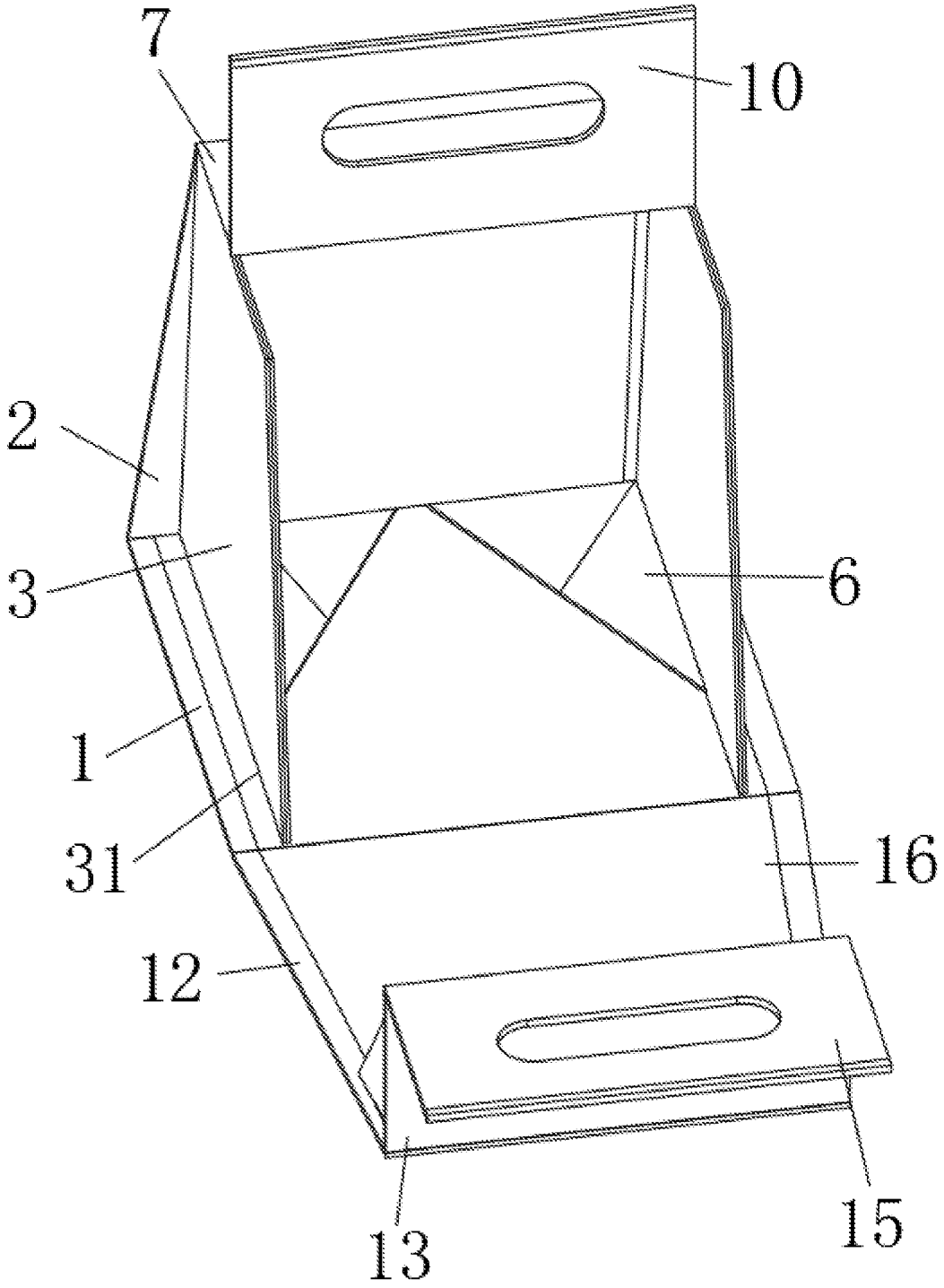
FIG. 7 is a perspective view of a partially expanded state of the present invention from another perspective.

As shown in FIG. 6, the second hinge 6 is a double crease folding structure, which defines the two creases in the above double crease as the fifth crease and the sixth crease respectively, and the middle area of the two creases is defined as the second movable area, and the part outside the second movable area is defined as the outer area.

Among them, the outer area of the fifth crease is attached and fixed to the second side plate 3, and the outer area of the sixth crease is attached and fixed to the bottom plate 1, and the second hinge 6 can make the second side plate 3 and the bottom plate 1 fold or expand to form an movable connection.

As shown in FIG. 8, when the second side plate 3 and the bottom plate 1 are folded into a planar structure, the bottom plate 1 and the first side plate 2 are unfolded at the maximum angle, the second movable area covers the area outside the fifth crease, and the second movable area is attached to the bottom plate 1.

When the second side plate 3 and the bottom plate 1 are folded into a planar structure, the bottom plate 1 and the first side plate 2 are unfolded at the maximum angle, the second movable area covers the outer area of the fifth crease, and the second movable area is attached to the bottom plate 1;

When the second side plate 3 and the bottom plate 1 are expanded at the maximum angle, the bottom plate 1 and the first side plate 2 are expanded at the minimum angle, and the second movable area is attached to the bottom plate 1.

The opposite side of the bottom edge 31 is connected with a first hinge 5.

The first hinge 5 is a double crease folding structure. The two creases in the above double crease are defined as the first crease and the second crease respectively, and the middle area of the two creases is the first movable area. The part outside the first movable area is defined as the outer area.

Among them, the outer area of the first crease is bonded and fixed to the second side plate 3, the outer area of the second crease is bonded and fixed to the first top plate 7, and the second side plate 3 and the first side plate 2 are folded into a planar structure when the first top plate 7 and the first side plate 2 are expanded at the maximum angle, the first movable area covers the area outside the second crease, and the first movable area is attached to the first top plate 7.

As shown in FIG. 6, both sides of the inner wall of the second top plate 13 are provided with third hinges 14, and the second top plate 13 is foldably connected to the third side plate 12 through the third hinges 14 on both sides.

The second top plate 13 is foldably connected to the third side plate 12 through two third hinges 14 on both sides. The third hinge 14 can make the second top plate 13 and the third side plate 12 fold or unfold to form a movable connection, and in the unfolded state, when the second top plate 13 is pulled upwardly, the third hinge 14 can fix the second top plate 13 and avoid a gap between the second top plate 13 and the second side plate 12.

Figure 4:
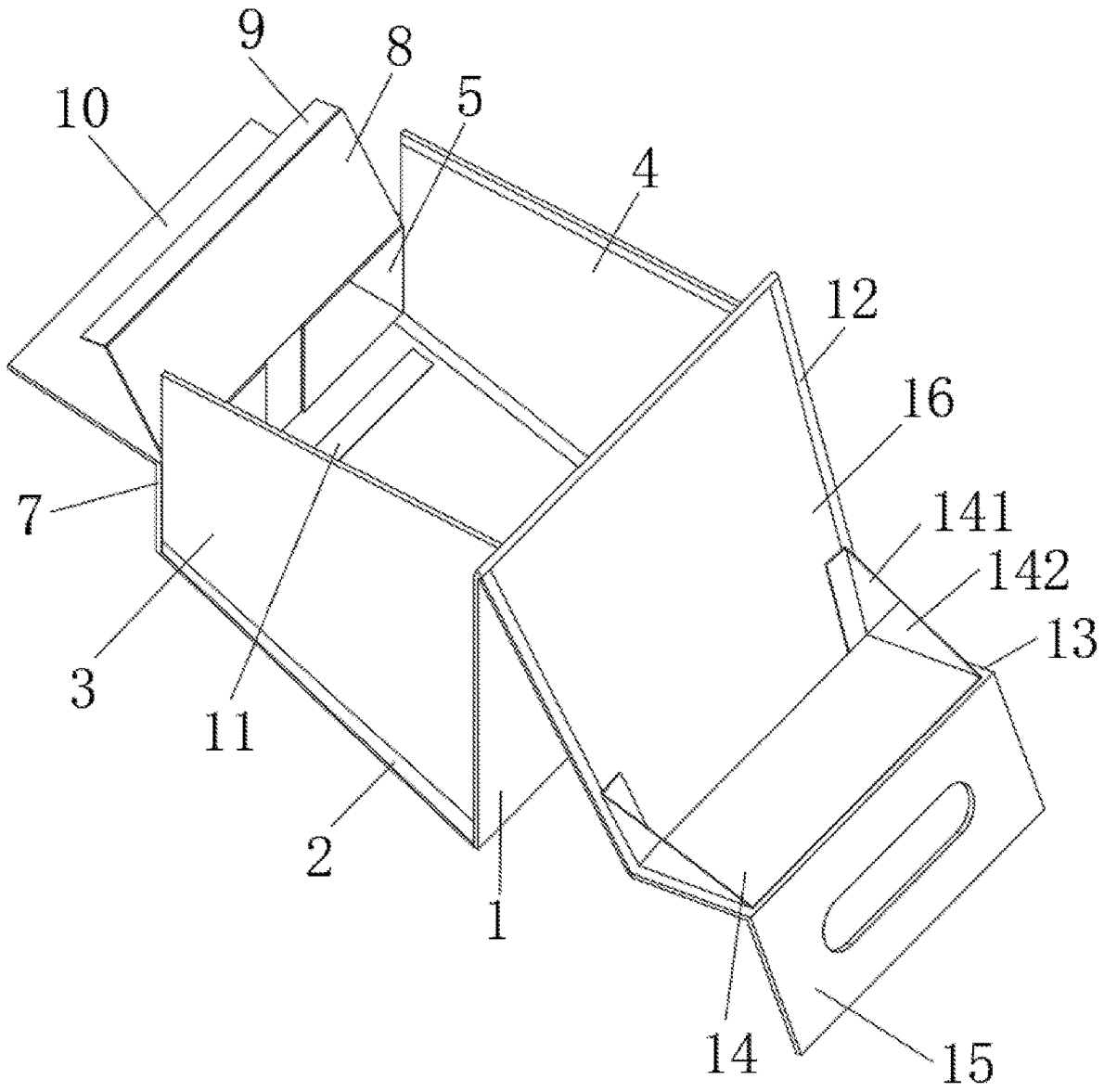
FIG. 4 is a three-dimensional schematic diagram of the present invention after the seam covering and pressing plate is folded outward.
Figure 5:
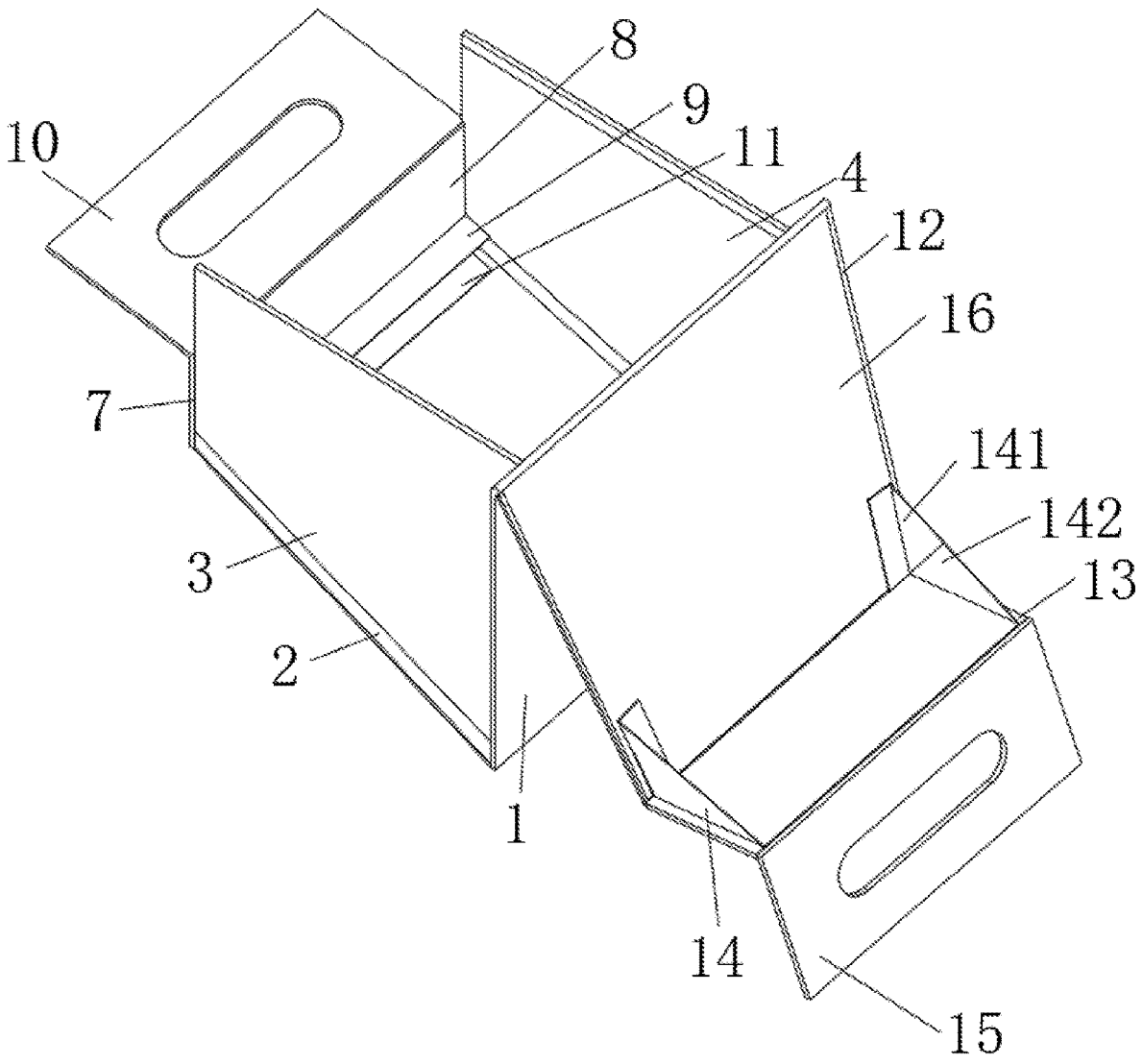
FIG. 5 is a three-dimensional schematic diagram of the present invention after folding the seam covering and pressing plate inward.

As shown in FIG. 4-5, it also includes a seam covering and pressing plate 8, a positioning plate 9 and a positioning-limit plate 11. The seam covering and pressing plate 8 is folded and connected to the connection between the first top plate 7 and the first lifting plate 10, defining the state when the seam covering and pressing plate 8 is folded inward and covers on the surface of the first hinge 5 as a locked state. When the seam pressing plate 8 is in the locked state, the positioning plate 9 is parallel to the first side plate 2 and is attached to the inner surface of the first side plate 2, the positioning-limit plate 11 locks the position of the positioning plate 9;

When it is necessary to make the first side plate 2 and the first top plate 7 in a three-dimensional structure, turn the seam covering and pressing plate 8 and the positioning plate 9 inward so that the seam covering and pressing plate 8 can cover the first hinge 5 and the positioning plate 9 is engaged between the position-limiting plate 11 and the first top plate 7, the position-limiting plate 11 can fix the positions of the seam covering and pressing plate 8 and the positioning plate 9 so that the first side plate 2 and the first top plate 7 are continuously in a three-dimensional structure, avoiding gaps between the first top plate 7 and the second side plate 3.

As shown in FIGS. 4-5, in order to protect the inner walls of the second side plate 3 and the first side plate 2, in this embodiment, a patch 4 is provided between the second side plate 3 and the first side plate 2. A part of the patch 4 is pasted on the inner wall of the second side plate 3, and the other part of the patch 4 is pasted on the first side plate 2. The patch 4 forms an impression, which is connected to the second side plate 3 and the first side plate 2. When placing the article, the article is separated from the second side plate 3 by the patch 4, thereby protecting the second side plate 3 and extending the service life of the second side plate 3.

As shown in FIG. 8, in order to extend the service life of the first lifting plate 10, the first top plate 7, the first side plate 2, the bottom plate 1, the third side plate 12, the second top plate 13, and the second lifting plate 15, in this embodiment, the inner walls of the first lifting plate 10, the first top plate 7, the first side plate 2, the bottom plate 1, the third side plate 12, the second top plate 13 and the second lifting plate 15 are all pasted with lining paper 16 on the inner walls.

The inner lining paper 16 makes the inner walls of the first lifting plate 10, the first top plate 7, the first side plate 2, the bottom plate 1, the third side plate 12, the second top plate 13 and the second lifting plate 15 more beautiful. The lining paper can connect the first lifting plate 10, the first top plate 7, the first side plate 2, the bottom plate 1, the third side plate 12, the second top plate 13, and the second lifting plate 15, and the inner lining paper 16 has good foldability, which is beneficial to the first lifting plate 10, the first top plate 7, the first side plate 2, the bottom plate 1, the third side plate 12, the second top plate 13 and the second lifting plate 15 long-term repeated folding extend the service life of the box.

In order to make the first lifting plate 10 and the second lifting plate 15 fit more closely, in this embodiment, the first lifting plate 10 and the second lifting plate 15 are provided with magnets that attract each other inside. The lining paper 16 covers the surface of the magnet. The magnet can attract the first lifting plate 10 and the second lifting plate 15 together in the second state, so that the foldable box has enhanced stability and durability while reducing the gap between the first top plate 7 and the second top plate 13.

As shown in FIGS. 1, 8 and 9, in order to facilitate the user to use the box, in this embodiment, the first lifting plate 10, the first top plate 7, the first side plate 2 and the second lifting plate 15, the second top plate 13 and the third side plate 12 are arranged symmetrically with respect to the bottom plate 1, and the two second side plates 3 are arranged symmetrically with respect to the bottom plate 1. The first lifting plate 10 and the second lifting plate 15 are both provided with mutually symmetrical through holes, which configured to be easily lifted by a user. The user can extend his hand to the inside of the through hole to lift the box. At the same time, when placing the box, the box can also be hung through the through hole, which brings more added convenience.

As shown in FIG. 6, in order to reduce the gap between the second top plate 13 and the second side plate, in this embodiment, the third hinge 14 includes a first flap 141 and a second flap 142. One side of the second flap 142 is attached to the second top plate 13, and one side of the first flap 141 is attached to the third side plate 12. When the third hinge 14 is folded inward, the first flap 141 and the second flap 142 form a seventh crease.

When the second top plate 13 and the third side plate 12 are folded into a planar structure: the second flap 142 and the first flap 141 are folded through the seventh crease, and the second flap 142 is attached to the first flap 141.

When the second top plate 13 and the third side plate 12 are unfolded into a spatial structure: the second flap 142 and the second top plate 13 are expanded 180 degrees relative to the seventh crease, and the third hinge 14 can be arranged while at the second state, the second top plate 13 and the second lifting plate 15 play a role of pulling, preventing the second lifting plate 15 from separating from the top of the second side plate 3, thereby further reducing the second top plate 13, which further reduces the gaps between the second top plate 13 and the second side plate 3.

As shown in FIGS. 8-9, in order to make the box have better foldability and expandability, in this embodiment, when the box is in the first state, the first lifting plate 10, the first top plate 7, and the first side plate 2. The bottom plate 1, the third side plate 12, the second top plate 13 and the second lifting plate 15 are on the same horizontal plane.

The seam covering and pressing plate 8 and the positioning plate 9 are folded outward to the inner wall of the first lifting plate 10.

The second side plate 3 is folded inwardly on the inner wall of the first side plate 2.

Both the first hinge 5 and the second hinge 6 are folded inward.

As shown in FIG. 1, in order to make the box have better foldability and expandability, in this embodiment, when the box is in the second state, the two second side plates 3 are symmetrically folded and stand on the top of the bottom plate 1.

The first side plate 2 and the third side plate 12 are folded symmetrically and stand on the top of the bottom plate 1. The inner walls of the first side plate 2 and the third side plate 12 are in close contact with the two sides of the second side plate 3 respectively.

The first top plate 7 and the second top plate 13 cover the top of the second side plate 3, and the adjacent sides of the first top plate 7 and the second top plate 13 are in contact.

The first lifting plate 10 and the second lifting plate 15 stand on the tops of the first top plate 7 and the second top plate 13 respectively and are connected by magnets.

The seam covering and pressing plate 8 is in a locked state.

The third hinge 14 expands into a plane.

Specifically, a method for using a foldable box is to unfold the folded box as follows:

Step 1: Unfold the folded first hinge 5 and the second hinge 6 so that the first hinge 5 completely fits the top plate 7 and the second hinge 6 are completely attached to the bottom plate 1, that is, the two second side plates 3 are folded outward and vertically erected. At this time, the two second side plates 3 pass through the second hinge 6 and the first hinge 5 respectively and pull up the bottom plate 1 and the first top plate 7;

Step 2: Fold the seam covering and pressing plate 8 and the positioning plate 9 inward so that the seam covering and pressing plate 8 covers the surface of the first hinge 5, and the position-limiting plate 11 clamps the positioning plate 9;

Step 3: Finally, fold the third side plate 12, the second top plate 13 and the second lifting plate 15 inward so that the magnets on the second lifting plate 15 and the first lifting plate 10 attract each other.

Although the present invention has been disclosed as above in preferred embodiments, it is not intended to positioning-limit the present invention. Those who have ordinary knowledge in the technical field of the present invention can make various changes and modifications without departing from the spirit and scope of the present invention. Therefore, the scope of the present invention shall be subject to that defined by the claims.

The invention claimed is:

1. A foldable box, characterized in that: a first state of the foldable box is a compressed and flat state, whereas a second state of the foldable box is an expanded three-dimensional spatial state, which forms an accommodation space; the foldable box includes: a first lifting board (10), a first top plate (7), a first side plate (2), a bottom plate (1), a third side plate (12), a second top plate (13), and the second lifting plate (15), which are configured to be sequentially folded; defining an edge of connection between the first side plate (2) and the first top plate (7) as a first connecting edge; the foldable box further comprises two second side plates (3), and the two second side plates (3) are respectively folded and connected to two adjacent sides of the first connecting edge on the first side plate (2) in a one-to-one correspondence, defining an edge connecting the second side plate (3) and the first side plate (2) as a second connecting edge, each second side plate (3) includes a bottom edge (31), the first hinge (5) and a second hinge (6) the first hinge (5) and the second hinge (6) are respectively correspondingly arranged on the adjacent sides on both sides of the second connecting edge; the second hinge (6) is a double crease folding structure, and the two creases in the double crease are defined as a fifth crease and sixth crease respectively, and middle area between the two creases is called a second movable area, an area outside the second movable area is defined as the outer area, wherein the outer area of the fifth crease is attached to the second side plate (3), and the outer area of the sixth crease is connected to the bottom plate (1) through a fixed connection; when the second side plate (3) and the bottom plate (1) are folded into a planar structure configuration, the bottom plate (1) and the first side plate (2) are expanded at a maximum angle, and the second movable area covers the fifth crease on the outer area, and the second movable area is attached to the bottom plate (1); when the second side plate (3) and the bottom plate (1) are expanded at the maximum angle, the bottom plate (1) and the first side plate (2) are expanded at the minimum angle, and the second movable area is attached to the bottom plate (1); the first hinge (5) is a double crease folding structure, and it is defined that the two creases in the double crease are the first crease and the second crease respectively, and the middle area between the two creases is the first movable area, the area outside the first movable area is defined as the outer area, wherein the outer area of the first crease and the second side plate (3) are attached and fixed, and the outer area of the second crease and the first top plate (7) are adhered and firmly connected; when the second side plate (3) and the first side plate (2) are folded into a planar structure, the first top plate (7) and the first side plate (2) are expanded to a maximum angle, the first movable area covers the area outside the second crease, and the first movable area is attached to the first top plate (7); when the second side plate (3) and the first side plate (2) are expanded at a maximum angle to form a spatial structure configuration, the first top plate (7) and the first side plate (2) are expanded at a minimum angle, and the first movable area is attached to the first top plate (7), and the second side plate (3), the first side plate (2), and the first top plate (7) to form a closed three-sided angle; the foldable box further comprises a seam covering and pressing plate (8), a positioning plate (9) and a position-limiting plate (11), the seam covering and pressing plate (8) is folded and connected to the connection between the first top plate (7) and the first lifting plate (10); forming the first side panel (2), the first top panel (7), the seam covering and pressing plate (8) and the positioning plate (9) are sequentially folded and connected along the length of the first side panel (2); the position-limiting plate (11) is fixedly connected to the surface of the first side plate (2); when the second side plate (3) and the first side plate (2) are expanded at a maximum angle and the seam covering and pressing plate (8) cover on the first top plate (7), the first movable area of the first hinge (5) is sandwiched between the first top plate (7) and the seam covering and pressing plate (8); defining the state when the seam covering and pressing plate (8) being folded inward and covering the surface of the first hinge (5) is a locked state, when the seam covering and pressing plate (8) is in the locked state, defining a crease where the first connecting edge is located as a third crease, the seam covering and plate (8) and the positioning plate (9) form a fourth crease, and the third crease is attached to the fourth crease; the positioning plate (9) is parallel to and attached to the first side plate (2), and is fitted on the inner surface of the first side plate (2), and the positioning plate (9) is clamped between the position-limiting plate (11) and the first top plate (7), and the position-limiting plate (11) locks the position of the positioning plate (9); both sides of the inner wall of the second top plate (13) are provided with third hinges (14), and the second top plate (13) is folded through the third hinges (14) on both sides and the third side plate (12) connection.

2. The foldable box according to claim 1, characterized in that a patch (4) is provided between the second side plate (3) and the first side plate (2), and one portion of the patch (4) is pasted on the inner wall of the second side plate (3), the other portion of the patch (4) is pasted on the first side plate (2), the patch (4) forms an indentation, and the indentation fits with the joint of the second side plate (3) and the first side plate (2).

3. The foldable box according to claim 2, characterized in that inner walls of the first lifting plate (10), the first top plate (7), the first side plate (2), the bottom plate (1), the third side plate (12), the second top plate (13), and the second lifting plate (15), are all pasted with lining paper (16).

4. The foldable box according to claim 3, characterized in that the inner sides of the first lifting plate (10) and the second lifting plate (15) are provided with magnets that attract each other, and the inner lining paper (16) covers the surface of the magnet.

5. The foldable box according to claim 4, characterized in that the first lifting plate (10), the first top plate (7), and the first side plate (2), and the second lifting plate (15), the second top plate (13), and the third side plate (12), are arranged symmetrically with respect to the bottom plate (1), two second side plates (3) are symmetrically arranged with respect to the bottom plate (1), and the first both the first lifting board (10) and the second lifting plate (15) are provided with mutually symmetrical through holes.

6. The foldable box according to claim 5, wherein the third hinge (14) comprises a first flap (141) and a second flap (142), and the second flap (one side of 142) is attached to the second top plate (13), and one side of the first flap (141) is attached to the third side plate (12), when the third hinge (14) is folded inward, a seventh crease is formed between the folded first flap (141) and folded second flap (142); when the second top plate (13) and the third side plate (12) are folded into a planar structure: the second flap (142) and the first flap (141) are folded through the seventh crease, and the second flap (142) is attached to the first flap (141); when the second top plate (13) and the third side plate (12) are expanded into a spatial structure: the second flap (142) and the second top plate (13) expand 180 degrees relative to the seventh crease.

7. The foldable box according to claim 5, characterized in that, when the foldable box is in the first state, the first lifting plate (10), the first top plate (7), and the first side plate (2), the bottom plate (1), the third side plate (12), the second top plate (13) and the second lifting plate (15) are in a same horizontal plane; the seam covering and pressing plate (8) and the positioning plate (9) are folded outwardly to the inner wall of the first lifting plate (10); the second side plate (3) is folded inwardly on the inner wall of the first side plate (2); the first hinge (5) and the second hinge (6) are both folded inwardly.

8. The foldable box according to claim 5, characterized in that, when the foldable box is in the second state, the two second side plates (3) are symmetrically folded and stand on the top of the bottom plate (1); the first side plate (2) and the third side plate (12) are symmetrically folded and stand on a top of the bottom plate (1), the inner walls of the first side plate (2) and the third side plate (12) are respectively connected to two edges of the two side plates (3) and form close contact; the first top plate (7) and the second top plate (13) cover the top of the second side plate (3), and adjacent sides of the first top plate (7) and the second top plate (13) are in contact; the first lifting plate (10) and the second lifting plate (15) stand on the top of the first top plate (7) and the second top plate (13) respectively and are connected by magnet attraction; the seam covering and pressing plate (8) is in a locked state; the third hinge (14) expands into a plane.

9. A method of using a foldable box according to claim 4, wherein a compressed folded box is expanded into a spatial state according to the following method: Step 1: expand the folded first hinge (5) and the second hinge (6) to make the first hinge (5) completely fit and attach to the first top plate (7), and the second hinge (6) completely fit and attach to the bottom plate (1), that is, the two second side plates (3) are folded outwardly to stand up vertically, and at the same time, the two second side plates (3) pull the bottom panel (1) and the first top panel (7) up, through the second hinge (6) and the first hinge (5) respectively; Step 2: fold the seam covering and pressing plate (8) and positioning plate (9) inwardly, so that the seam covering and pressing plate (8) covers the surface of the first hinge (5), and the position-limiting plate (11) will squeeze the positioning plate (9); Step 3: Finally, fold the third side plate (12), the second top plate (13) and the second lifting plate (15) inwardly, so that the magnets of the second lifting plate (15) and the first lifting plate (10) attract each other.

* * * * *